United States Patent [19]

Lampinen

[11] 4,357,758

[45] Nov. 9, 1982

[54] METHOD AND APPARATUS FOR DRYING OBJECTS

[75] Inventor: Markku Lampinen, Turku, Finland

[73] Assignee: Valmet Oy, Finland

[21] Appl. No.: 212,263

[22] Filed: Dec. 2, 1980

[30] Foreign Application Priority Data

Jul. 1, 1980 [FI] Finland ..... 802106

[51] Int. Cl.[3] ..... F26B 3/00

[52] U.S. Cl. ..... 34/9; 34/15; 34/16; 34/92; 34/95; 34/113; 34/116; 34/123; 44/27

[58] Field of Search ..... 34/9, 15, 16, 95, 113, 34/116, 123, 92; 44/10 J, 27

[56] References Cited

U.S. PATENT DOCUMENTS

| | | | |
|---|---|---|---|
| 2,209,759 | 7/1940 | Berry | 34/9 |
| 3,296,710 | 1/1967 | Krikorian | 34/95 |
| 3,925,905 | 12/1975 | Zeiffer | 34/16 |
| 4,079,524 | 3/1978 | Amicel et al. | 34/95 |

*Primary Examiner*—John J. Camby
*Attorney, Agent, or Firm*—Steinberg & Raskin

[57] ABSTRACT

Objects constituted by a porous web-like material, such as a paper web, a granular material, such as peat, or a solid material such as wood, are dried by placing the same in contiguity with a fine porous liquid suction surface which itself is in liquid communication with a liquid volume with the latter being in communication with apparatus by which the liquid in the liquid volume is maintained at an underpressure relative to the pressure of the liquid in the object to be dried so that liquid flows from the object into the fine porous suction surface. The liquid flow can be enhanced through the application of an over pressure or through the direction of radiation onto the object to be dried. In one embodiment, the fine porous liquid suction surface comprises the surface of a rotatably mounted cylinder whereby a web-like object, such as a paper web, can be dried as the same is carried on the cylinder surface.

29 Claims, 18 Drawing Figures

METHOD AND APPARATUS FOR DRYING OBJECTS

BACKGROUND OF THE INVENTION

This invention relates generally to methods and apparatus for drying objects and, more particularly, to such methods and apparatus for drying an object constituted by a porous web-like material, such as a paper web, a granular material such as peat, or a solid material, such as wood.

Preliminarily, the method and apparatus of the present invention will be described below mainly in connection with an application whereby a paper web is dried. However, it is understood that the method and apparatus of the present invention are equally applicable in connection with drying granular material, such as peat, and solid material, such as wood. In this connection, examples are set forth below whereby the present invention is applied to the drying of timber and of peat. Among the various applications of the drying apparatus of the method of the invention are, among others, the drying of various textile webs, leather, various types of sheet and board products, other types of web-like products, granular and powdery products such as chemicals, fodders, peat and the like.

It should also be noted that the method and apparatus of the present invention are described below in connection with the removal of water from the object to be dried since such dewatering constitutes the most important application of the present invention. However, it is understood that the present invention is equally applicable to the removal of other liquids from an object to be dried.

Conventionally, a porous paper web running through a paper machine is dried initially by dewatering on a fabric, such as a wire, or between two fabrics. Such initial dewatering reduces the moisture content of the paper web to a value $u_v=5.7$ to 2.3 (g of $H_2O$ per g of dry matter), depending upon the brand of paper. Subsequently, further removal of water from the web is accomplished in the press section of the paper machine by passing the web in the nips of press rolls in which a porous felt is generally also applied to enhance the dewatering. The moisture content of the paper web is generally reduced in the press section of the paper machine to a value $u_v=1.6$ to 1.2. Following the press section, the paper web is dried through evaporation, e.g., utilizing multiple cylinder dryers, where the web to be dried is placed in contact with steam-heated, smooth-surfaced drying cylinders. The ultimate moisture content of the paper web is generally in the range $u_v=0.05$ to 0.1.

The above-described method of drying a paper web is not energy efficient. Thus, it need only be noted that drying by evaporation consumes remarkable quantities of energy since the energy required for evaporation of water is about 2500 kJ/kg.

SUMMARY OF THE INVENTION

Accordingly, one object of the present invention is to provide new and improved methods and apparatus for drying porous web-like materials, powdery or granular materials and/or solid materials. Another object of the present invention is to provide new and improved methods and apparatus for drying materials which are significantly superior in energy economy relative to thermal evaporation methods of drying of the prior art.

Briefly, in accordance with the present invention, these and other objects are obtained by providing a method and apparatus wherein the object to be dried is placed in contiguity with a fine-porous suction surface saturated with a liquid and which is in liquid communication with a volume of liquid which is maintained at an underpressure or reduced pressure relative to the pressure of the liquid in the object to be dried.

The term "suction surface saturated with liquid" as used herein shall be understood as meaning that the ambient atmosphere, generally air, cannot permeate the suction surface with the differential pressures applied according to the present invention between the air and liquid. This provision constitutes an essential difference between the present invention and conventional drying procedures known in the prior art. More particularly, in conventional suction drying arrangements, e.g., suction rolls in a paper machine, air will pass through the suction surface (the surface of the suction roll) in addition to the liquid being dewatered from the web. Of course, in such conventional procedures, air also passes through the object that is being dried so that the drying thereof is in fact based on the friction which exists between the liquid and the air. In order to maximize the friction as measured by the differential pressure of air across the object to be dried, the air flowing through the suction surface must be maximized. Of course, however, this results in high energy costs. Furthermore, even with maximized efficiency of operation of other conventional arrangements, the drying obtained is not as good as desired. For example, in paper machines, moisture contents $u_v$ of only about 2.3 have been obtained.

According to the present invention, the pores of the fine-porous suction surface have radii mainly within the range of about 0.05 to 2 $\mu$m. The suction surface is saturated with liquid by placing the same in communication with liquid confined in a liquid volume defining means which itself communicates with means for creating an underpressure or vacuum.

DESCRIPTION OF THE DRAWINGS

A more complete appreciation of the present invention and many of the attendant advantages thereof will be readily appreciated as the same becomes better understood by reference to the following detailed description when considered in connection with the accompanying drawings in which.

DESCRIPTION OF THE PREFERRED EMBODIMENTS

Figure 1:
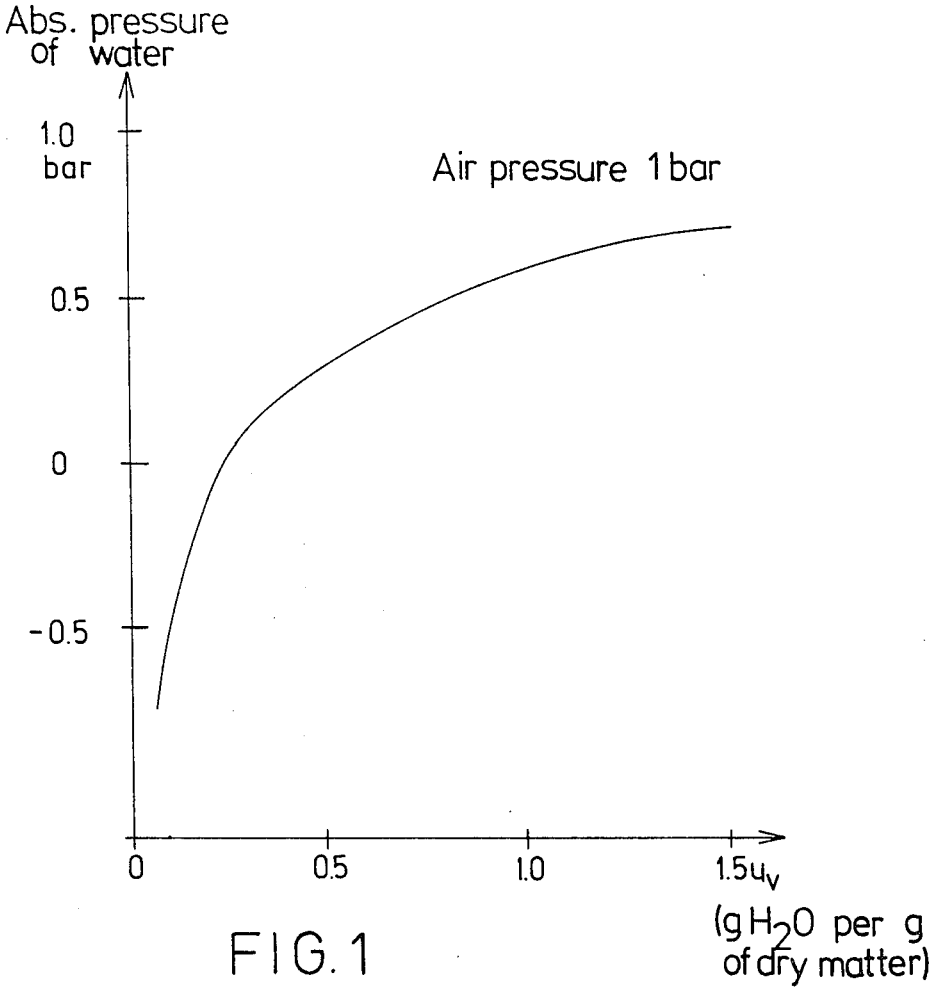
FIG. 1 is a graphical illustration showing the relationship between the water content of newsprint material with respect to the absolute pressure of the water at an ambient pressure of one bar.
Figure 2:
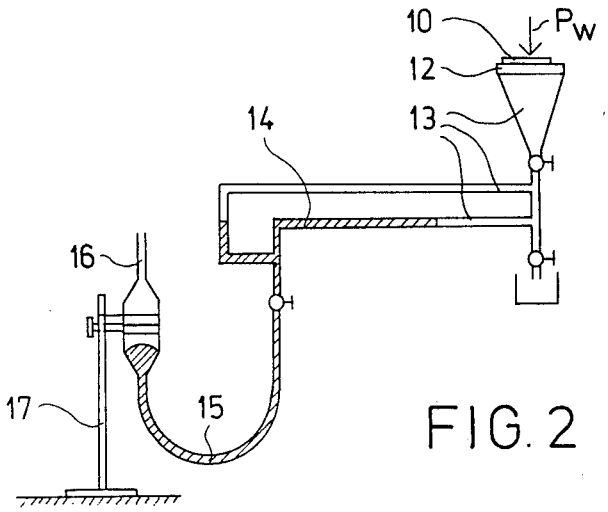
FIG. 2 is a schematic illustration of test apparatus illustrating the principles of the present invention.

Referring now to the drawings wherein like reference characters designate identical or corresponding parts throughout several views, and more particularly to FIGS. 1 and 2, it is understood that water generally resides in a wet paper sheet or web at three distinct locations, namely, on the surface of the sheet, in the interfiber pores, and in the fibers themselves. When the moisture content is very high, water will reside on the surface of the sheet and the pressure of such water essentially equals the pressure of the ambient air. As the quantity of water in the sheet diminishes, the pressure of such water correspondingly decreases simultaneously. In fact, at minimal moisture content, the pressure of the water may obtain a negative value meaning that the water is then in its entirety in a state of tensile stress. FIG. 1 illustrates the relationship between moisture content and the pressure of water in newsprint at an ambient pressure or one bar. This graph was obtained utilizing the so-called mercury method in newsprint at a temperature of 20° C.

Referring to the experimental apparatus illustrated in FIG. 2, the principles of the drying method of the present invention will now be described. A plate 12 formed of a very dense sintered material is saturated with water. Below plate 12 is a volume of water 13 which is maintained at a considerable subatmospheric pressure by means of lowering one end of a mercury column. In actual applications, such subatmospheric pressure is maintained by means of a syphon or pump. The pores or microcapillaries in the sinter plate 12 are, however, not voided of the water contained therein in spite of the subatmospheric pressure applied to the water volume 13 due to the presence of surface forces acting between the water contained in the pores and the material of the sinter plate. If the radius of the largest pore in sinter plate 12 is R, then the water retentive capacity of the sinter plate 12 is measured by the highest subatmospheric pressure $\Delta p$ which can be imposed on the water 13 while the plate 12 still remains water-saturated can be calculated by the formula:

$$\Delta p = \frac{2\,\gamma \cos\theta}{R} \tag{1}$$

where: $\delta$ designates the surface tension of the water and $\theta$ designates the contact angle between the free surface of the water and the surface of the sinter plate material. Using the above formula, if the pore radius R is 1.2 $\mu$m and the contact angle is 30°, then the maximum underpressure for water at 20° C. is 1 bar ($\delta = 70 \times 10^{-3}$ N/m).

When a wet paper 10 or like porous object to be dried is placed upon the sinter plate 12, the water in the sinter plate 12 and in the paper 10 will constitute a coherent water layer and since the pressure of the water both in and below the sinter plate 12 is reduced, water will begin to flow out from the paper 10 and through the sinter plate 12. Such water flow will terminate when the paper 10 has become so dry that the pressure of the water contained therein is the same as the pressure of the water of volume 13 under the sinter plate 12.

Thus, referring to the experimental apparatus illustrated in FIG. 2, the object to be dried 10 is placed on a sinter plate 12 which is saturated with water and which is in communication with a water volume 13 maintained at subatmospheric pressure by means of appropriately located mercury columns 14 which run through a rubber tube 15 which communicates with a source of mercury 16 which is open to the ambient atmosphere and which is supported by a stand 17.

The finer the porosity of the sinter plate 12 or other equivalent porous member, the higher are the underpressures which can be utilized without incurring the risk of voiding the pores of the plate 12 of water and, consequently, the greater the dryness of paper 10 which can be achieved. Thus, as seen in FIG. 1, it is theoretically possible to obtain a value $u_v$ of 0.3 when the water volume 13 under plate 12 is maintained at a pressure under 0.9 bar subatmospheric.

It is possible utilizing the present invention to dry paper or other equivalent object to be dried with any requirement for thermal drying being completely eliminated. In this connection, FIG. 1 essentially illustrates the difference between the pressures of water and air. If the pressure of the air is increased from 1 to 2 bars, and the water at an absolute pressure 0.1 bar, a value $u_v$ of 0.08 can theoretically be obtained. Of course, in an arrangement effecting the result described above, the sinter plate must have pores which are so fine that its water retentive capacity $\Delta p$ is greater than 1.9 bar. This implies that the radii of the pores, R, is less than 0.6 $\mu$m if $\theta = 30°$. The pressure of saturated water at 20° C. is 0.023 bar and a pressure lower than this cannot be imposed on the water since the latter would then begin to boil.

Further examples of the application of the method of the present invention will now be set forth.

EXAMPLE 1

Figure 3:
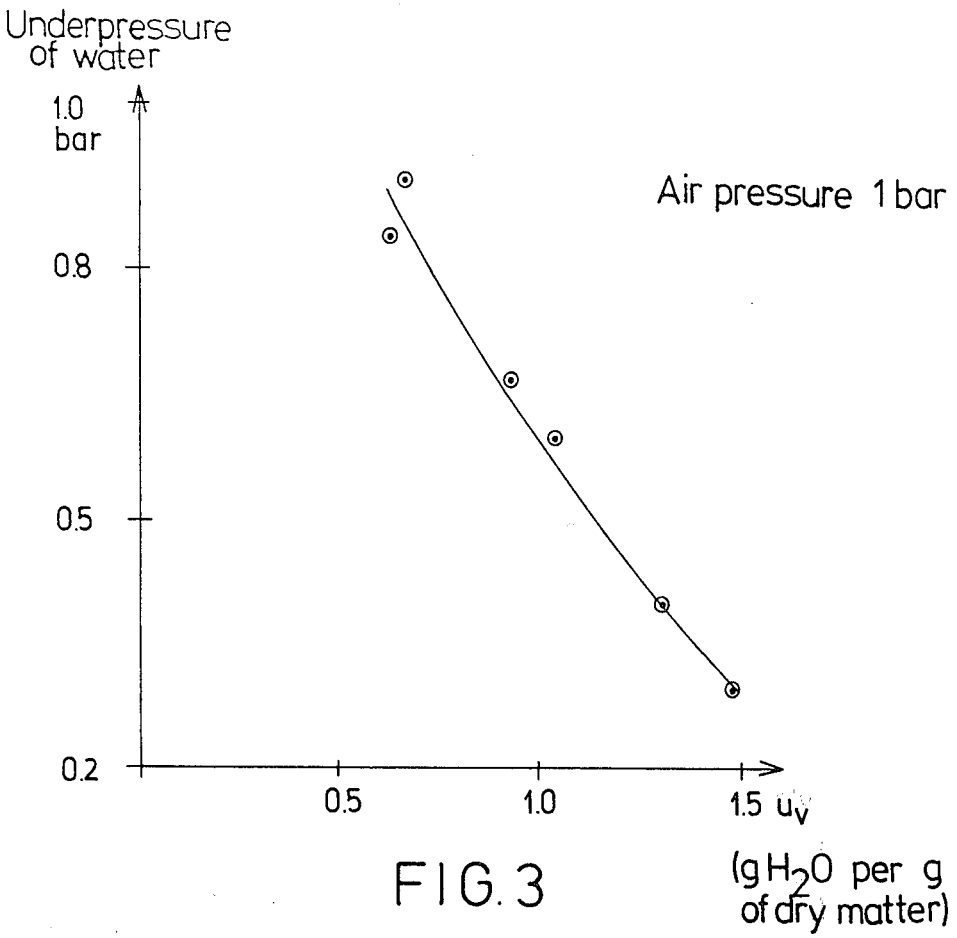
FIG. 3 is a graphical illustration showing the results of an experimental procedure conducted according to the present invention wherein the object to be dried comprised a particular porous board.

Referring to FIG. 3, the results of measurements obtained utilizing a ceramic plate constructed of Diapor material are illustrated. Th largest pores in such ceramic plate have a diameter of between 1 and 2 μm while the average pore size is 0.8–1.5 μm. The porosity of the plate, i.e., the proportion of volume of gas in the dry plate is 0.42–0.53. It should be noted that the porosity of the plate is also an indication of the proportion of perforations or openings at the end face of plate 12 which of course constitutes the fraction of the surface area of the end face of plate 12 which is saturated with water during operation. It is thus clear that the sinter plate 12 should desirably have the highest possible porosity so that the suction action will take place over the largest possible area of the end face of plate 12.

FIG. 3 illustrates the results of measurements obtained utilizing the Diapor plate. The best result obtained, i.e., a dry matter content $u_\nu$ equals 0.64, was achieved by urging the paper against the sinter plate with a water impermeable soft rubber member having a thickness of 4 mm. and at a pressure of about 1 bar. Such Diapor ceramic plate is manufactured of earth silicates and is available from Schumacher of Bietigheim, West Germany.

EXAMPLE 2

The fine porous suction surface was constituted by a nylon film, namely Nylon 66, Polyamide, Pall, England. The nylon film has a water retention capacity which is even greater than that of the ceramic plate utilized in Example 1 and which has a rather high porosity, namely about 80%. The nylon film is quite thin, namely about 0.1 mm and, accordingly, its flow resistance is quite low. This latter feature is important in that it renders the nylon film suitable for uses in applications wherein the time provided for drying to occur is quite short, such as in the case of Example 3 below. The results of the experiment utilizing the nylon film illustrated in FIG. 11 at two different values of air pressure, namely $pu_1=1.2$ bar and $pu_2=3.0$ bar absolute.

EXAMPLE 3

In this example, the present invention is applied in connection with a paper machine having a speed of 1,000 m/min. and wherein a water suction cylinder constructed according to the present invention has a diameter of 1.8 meters and wherein the paper web laps the water suction cylinder over a sector having an angle of 270°. If it were desired to effect drying of newsprint material having a weight of 45 g/m$^2$ with a moisture content $u_\nu=1.5$ to a moisture content $u_\nu=0.64$, it is possible to calculate the velocity of water flow from the paper web to accomplish these requirements. In this connection, it is understood that a nylon film of the type described above in connection with Example 2 is used as the cylindrical surface of the water suction cylinder. Thus, the drying time is calculated as follows:

$$\Delta t = \frac{\pi \cdot 1.8 \cdot 270/360}{1000/60} = 0.25 \text{ s}$$

Having this value for the drying time, the average water flow velocity is calculated as follows:

$$v = \frac{0.045 \cdot (1.5 - 0.64)}{1000 \cdot 0.25} \text{ m/s} = 0.15 \text{ mm/s}$$

From the above, it is seen that the nylon film of Example 2 has a permeability which renders the same sufficient such that the velocity of flow of 0.15 mm/sec. will be reached with a 0.03 bar differential pressure. It is noted that the nylon film in the present example requires a porous material to be situated under it, preferably having a porosity substantially the same as that of the nylon film, namely 80%, in order to provide adequate mechanical support to the film.

EXAMPLE 4

With the arrangement illustrated in FIG. 2, experiments were also carried out in connection with drying peat. Used in the tests was Sphagnum peat acquired from Keinusuo Bog in Loimaa, which is well known to dry with greater difficulty than sedge peat. The peat sample was transferred directly from the bog in a wet state in a plastic bag and ground in a laboratory in its wet condition between two grinding bricks. The fine-porous suction surface employed was parchment paper. The peat was urged at a pressure of about 10 bars by means of an elastic band against the parchment paper and the pressure of the water volume 13 was adjusted to 0.21 bar. The moisture content obtained was $u_\nu=0.82$. When the pressure at which the peat was urged against the parchment paper was reduced to 1–2 bars, the moisture content obtained was $u_\nu=1.13$. In both test runs, the air pressure was 1 bar and the drying time was 30 seconds. It is interesting to note that the value $u_\nu=0.82$ represents a 45% moisture content if the latter is referred to the wet weight of the peat and this is sufficient so that in this state the peat is already suitable for direct burning.

As noted above, the present invention is particularly adapted for use in connection with drying cylinders in a paper machine. It is important in this regard to consider the significance of centrifugal force with respect to the method of the present invention.

Consider a rotating water system wherein the velocity of the outer periphery at a radius $R_2$ equals v. In such a case, the water pressure which prevails at the outer periphery is higher by an amount $\Delta p$ than the pressure of water located at an inner radius. The value of $\Delta p$ can be calculated utilizing the following formula:

$$\Delta p = \frac{\rho \cdot v^2}{2} \cdot \left(1 - \left(\frac{R_1}{R_2}\right)^2\right)$$

If it is assumed that $v=16.7$ m/s, $R_2=0.9$ m and the permissible differential pressure $p=0.05$ bar then it follows from this formula that $R_1=0.884$ m and therefore, that the maximum allowable thickness of the water layer is 16 mm. This necessarily implies that as long as the cylinder is rotating, that withdrawal of water from the rotating cylinder cannot be accomplished at the center thereof but, rather, must be disposed at the periphery of the cylinder.

Figure 4A:
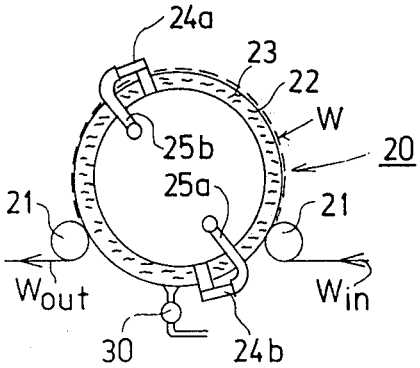
FIGS. 4*a* and 4*b* are front and side views, respectively, of a cylinder-type water suction drying apparatus according to the present invention.
Figure 4B:
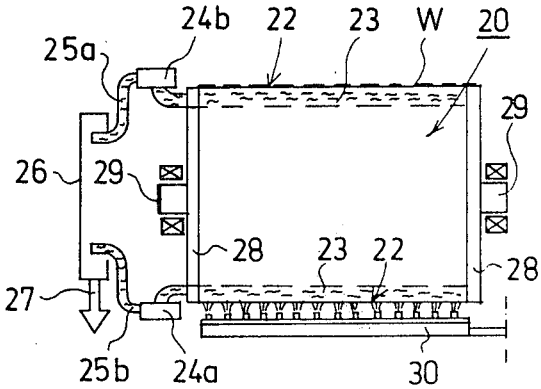

Turning now to FIGS. 4*a* and 4*b*, an embodiment of the apparatus of the present invention as applied to a cylinder drying section is illustrated. A paper web $W_{in}$ enters the drying section and is conducted by a guide roll 21 so as to run over the surface of the cylinder 20 and depart therefrom over guide roll 21 at $W_{out}$. Thus, the web W laps a water suction surface 22 of cylinder 20 over a sector which is preferably in excess of 180°. The cylinder surface is a fine-porous suction surface 22 of a type described above which directly communicates with water volume 23 which extends about the inner periphery of cylinder 20 over its entire breadth. A pair of water pumps 24*a* and 24*b* are connected to the water volume 23 and revolve together with the cylinder affixed to one end 28 thereof, the other end 28 being closed. The cylinder 20 is carried by journal pins associated with bearings 29. The suction pumps 24*a* and 24*b* are fitted with drain pipes 25*a* and 25*b* for discharging water into a stationary drain connector 26 from where water is discharged from a pipe 27. Electrical power is supplied to pumps 24 by means of carbon rings (not shown) mounted on the cylinder shaft. If the rate of water suction is provided to be 0.15 mm/sec. and if the water volume 23 is 15 mm. in height and the cylinder 20 is 8 m in breadth, the water flow velocity at the axial end of water volume 23 in a system with unilateral water withdrawal will be about 0.08 mm. per second. Thus, no difficulties should be encountered for providing a uniform water suction over the breadth dimension of the cylinder 20.

As noted above, in order to provide the fine-porous suction surface 12,22 with a high water retentive capacity, the same should have very small pores, i.e. less than 1 μm in size. Such pores or microcapillaries are so small that even bacteria cannot be admitted. Thus, no solid particulate or fibrous materials can penetrate into the porous surface 12,22 and, therefore, the same will remain on its surface. For this reason, it is desirable that means be provided for cleaning the porous surface and in this connection, a water jet 30 is disposed between guide rolls 21 on the other side of cylinder 20 so that the surface 22 can be rinsed when desired.

Figure 5:
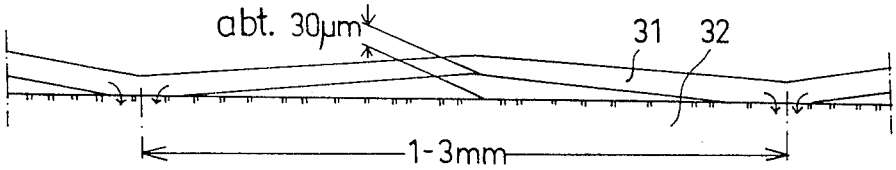
FIG. 5 is a schematic illustration showing the actual contact between the fine-porous suction surface and paper.
Figure 6A:
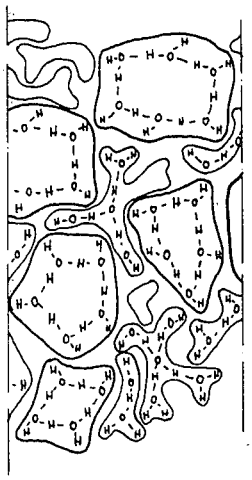
FIG. 6*a* is a schematic illustration showing the manner in which water molecules are grouped in an unrestricted volume of water.
Figure 6B:
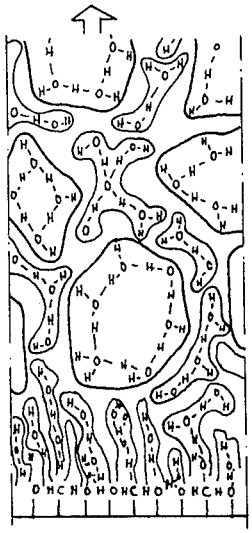
FIG. 6*b* is a schematic illustration showing the manner in which water molecules are grouped when the same are situated adjacent to cellulose.

Since paper is generally constituted of fibers which in a first approximation have a generally cylindrical shape with diameters of about 30 μm and lengths of about 1–3 mm., it is understood that a paper surface will not even closely approximate a strict mathematical plane. Consequently, only a few points of the paper surface will be in immediate contact with the water suction surface in the practice of the present invention. This situation is illustrated in FIG. 5 wherein contact between a water suction surface 32 and paper 31 is illustrated in a direction at right angles to the direction of travel of the paper web.

Water will flow from the paper into the suction surface according to the invention only at those points which are in mechanical contact with the water suction surface. It therefore follows that a substantial portion of the water to be removed from the paper must flow in a direction which is parallel to the plane of the paper, i.e., from areas between the points of contact between the paper and water suction surface to the points of contact. It would therefore appear and it has been experimentally confirmed that better drying action will be obtained with thicker paper than thinner paper. However, these differences have proven to be relatively minor as shown by tests comparing the drying rate of fine paper and newsprint.

In order to achieve a uniform suction effect in view of the foregoing considerations, it has been found advantageous to utilize with the water suction surface 12, 22, 32 a resilient material which will adapt itself to the surface configuration of the paper or other object to be dried. In this manner, not only will the ultimate dryness of the object be increased but, additionally, the rate of drying will be substantially improved when such a resilient water suction surface is utilized. Thus, the flow of water in the direction of the plane of the paper, even through a distance of only 1 mm. to a point of contact with the water suction surface, requires a relatively long time which may constitute a limiting factor for the duration of the entire drying procedure of the present invention. Therefore, it has been found expedient, for example, in the arrangement described in connection with Example 2 above, to provide a resiliently porous material course under the nylon film which in turn is situated upon the surface of a foraminous steel shell. Of course, the material course should not be formed of a material which is overly soft since the amount of deformation required to facilitate the surface contact of the water suction surface with the paper is relatively small as best seen in FIG. 5 and if the material course were overly soft, a danger would exist that the pores of the water suction surface 12, 22, 32, might be occluded by being compressed. It is also possible that by utilizing a nylon film of suitable thickness, the surface thereof can be rendered sufficiently resilient to achieve the results described above.

It should also be noted that in some circumstances the method of the present invention can be carried out with the fine-porous water suction surface being constituted by the object to be dried itself. For example, if the object being dried, or any surface thereof, has a sufficiently fine porous structure, there would be no requirement to provide a separate fine-porous water-suction surface. In such case, the method of the present invention would be carried out by placing the object to be dried upon the water volume which would be in fluid communication with the fine-porous surface of the object itself whereupon an underpressure would be applied to the water volume.

The drying action accomplished by the method and apparatus of the present invention will also be enhanced by pressing the paper or other object to be dried against the water suction surface with a relatively large pressure. In this manner, a greater number of contact points between the paper and the suction surface will be obtained thereby promoting the flow of water from the paper into the water suction surface.

It will be understood that it is extremely important that the side of the object to be dried opposite from the side in contact with the water suction surface be maintained in communication with ambient air so that as the water is removed from the object to be dried, air will flow in to replace the same. This fact has been proven in experiments wherein paper to be dried was pressed against the water suction surface by means of rubber which was impermeable to air. In this case, the paper remained significantly wetter than in a case where the air-permeable rubber was utilized for the same purpose. Of course, this phenomenon is understandable when one considers paper as being composed of small tubular cavities which are filled with water when the paper is wet. During drying, the tubular cavities are emptied of the water at one end while replacement air flows into the tubular cavities at the other ends. However, if no air can flow into the tube to replace the water being emptied (as in the case where air-impermeable object is located over the surface thereof) a vacuum is created in the tubular cavities inhibiting the withdrawal of water from the paper.

Figure 11:
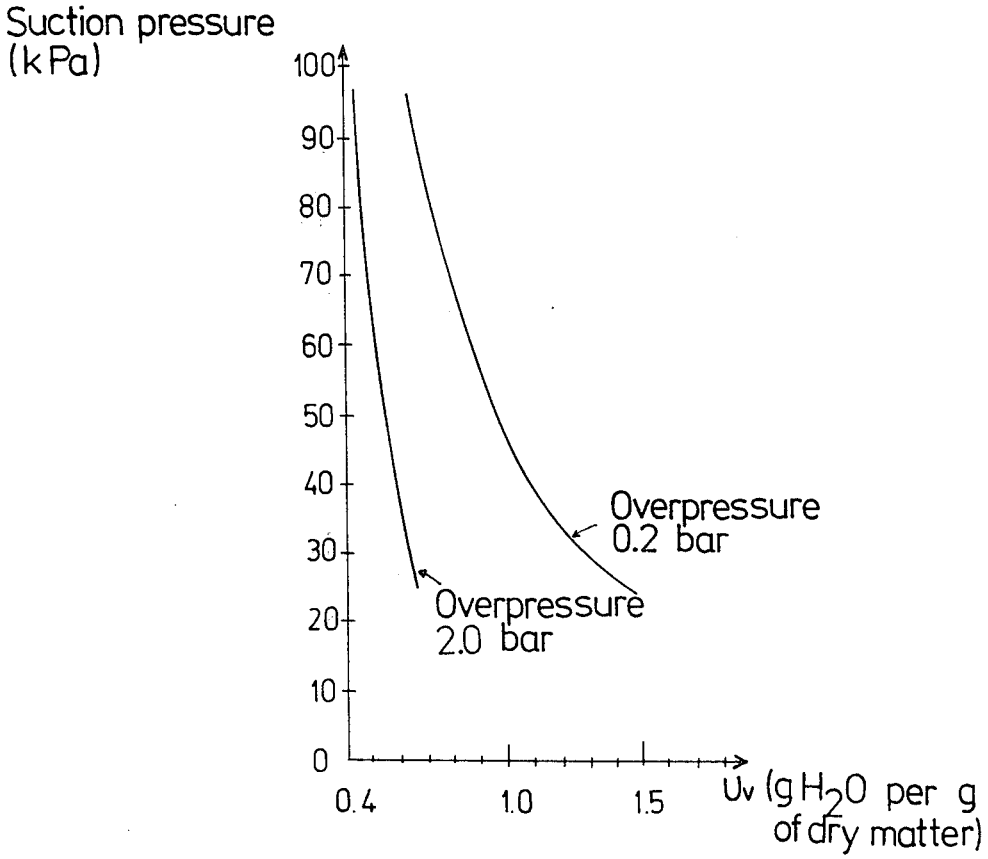
FIG. 11 is a graphical illustration showing the affect of the application of an overpressure on the object being dried when using a nylon film as the fine-porous suction surface.

Referring to FIG. 11, this graph illustrates that in accordance with the present invention, the paper being dried will attain a higher dryness when ambient air pressure is high. It follows that a further advantage is obtained by pressurizing the ambient atmosphere in that water flow from the paper or like object to be dried into the water suction surface will be accelerated. This effect will be readily understood if it is considered that each of the tubular cavities mentioned above has its water-filled end placed against the water suction surface and wherein compressed air is introduced into the opposite empty end. In this manner, the water will be "pulled" into the water suction surface at one end and "pushed" into the water suction surface at the other end.

For the above reasons, it is highly advantageous in the present invention to exert a heavy pressing on the paper or other object to be dried against the water suction surface utilizing a material which is porous to air such, for example, as a porous rubber material, while at the same time introducing pressurized air through the porous pressing member. In this manner, not only will the paper contact the water suction surface over a larger number of contact points but, additionally, the pressurized air will promote the water flow by exerting a "pushing" effect. Various different arrangements can be utilized to accomplish these steps.

Another manner in which water flow from the object to be dried into the water suction surface can be enhanced will be better understood by considering the molecular state of water in paper or in a like porous material.

Referring to FIG. *6a* which illustrates the grouping of water molecules in a free state, a water molecule has an electric dipole by reason of which the positive end or hydrogen-side end of the molecule will align itself towards the negative end of a neighboring molecule so that a relatively weak bond is created between the adjacent water molecules. Such a bond is generally referred to as a hydrogen bond since the same is generally observed only in substances which contain hydrogen. Such hydrogen bonds impede the motion of water molecules. Thus, without the existence of hydrogen bonds, water would boil at about −100° C. and, therefore, would be in a gaseous form at room temperature. However, owing to the hydrogen bonds water molecules form chains and for this reason the boiling point of water is about 200° higher than it would be in the absence of such hydrogen bonds. Of course, the mechanism described above is valid for so-called "free water" wherein the molecules obtain this configuration absent the influence of any external factors.

Referring to FIG. *6b*, the presence of cellulose adjacent to the water molecules will constitute an external influence which will disturb the mechanism described above in connection with so-called "free water". The presence of cellulose adjacent to water molecules results in stronger hydrogen bonds being created between water molecules which are close to the cellulose than the hydrogen bonds existing between water molecules remote from the cellulose, i.e. in free water. It will therefore be understood that in connection with the water suction drying according to the invention that water is being drawn away from cellulose, the molecular chains will break at the weakest bond and, accordingly, the water bound to the surface of the cellulose will tend to remain in the paper. An "unselected" increasing of the temperature does not appreciably improve the situation. Thus, although it is true that the bonds of the water molecules to the cellulose will weaken with increasing temperature, it is also true that the hydrogen bonds between the free water molecules will be equally weakened and, therefore, the free water molecular chains will be broken more easily than these at normal temperatures. Thus, it was found during experiments that a heating in a warm water bath prior to effecting the method of the invention had no appreciable effect on the drying accomplished.

In order to understand the orders of magnitude of the bonds discussed above, FIGS. *7a* and *7b* illustrate the surface energies which had been calculated for beech wood. Thus, FIG. *7a* illustrates the difference of the Helmholtz energies, $f_2{}^Sa^{(2)}$, of water bound to beech wood and of free water. Similarly, FIG. *7b* illustrates the difference of the Helmholtz energies, $f_1{}^Sa^{(1)}$, of the surface of dry beech wood and of the wood material directly behind the surface.

As an example, assume that $f_2{}^Sa^{(2)}=50$ kJ/kg at a given moisture content and a given temperature. From this, the amount of work required to detach one water molecule from the sphere of influence of a cellulose molecule can be calculated as follows for one kilomole:

$$W=18\cdot 50=900\ \text{kJ/kmol}=900\ \text{J/mol}$$

and, therefore, the work required to detach one molecule is calculated as follows:

$$W=900\ \text{J}/6.02\cdot 10^{23}=1.5\cdot 10^{-21}\text{J}$$

It is seen from the above that if it is desired to dry the paper to the ultimate dryness possible utilizing the method of the present invention, a certain amount of external work is required to detach the water molecules which are situated within the sphere of influence of the cellulose molecules. The amount of this work is clearly of a different order of magnitude than that required for the evaporation of water (cf. 50 kJ/kg vs. the evaporation energy of water, 2500 kJ/kg).

One manner of providing such external work has already been discussed above, namely, the use of compressed air to "push" the water towards the water suction surface.

Figure 9:
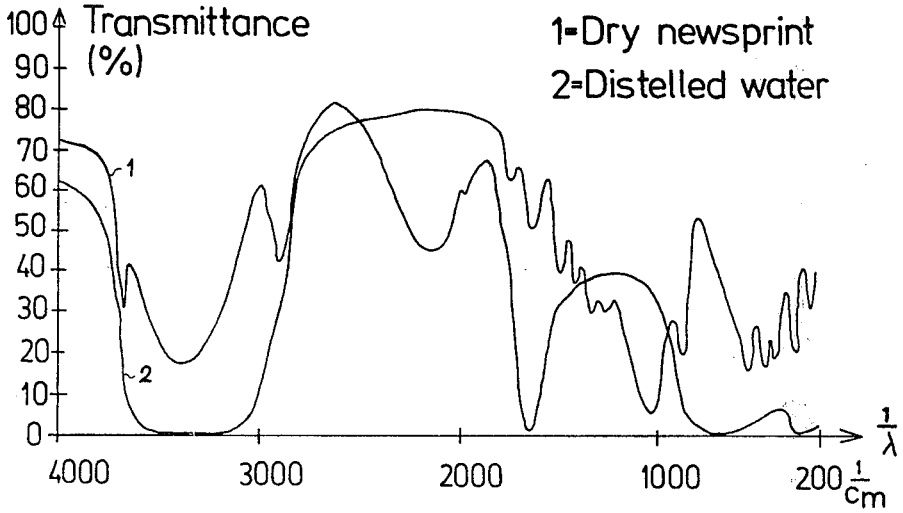
FIG. 9 is a graphical illustration showing the permeability to infrared radiation of distilled water and of newsprint material.

Another method of facilitating the drying procedure, other than the use of compressed air, is the use of infrared radiation which is effective either in the range of the bending and/or vibration frequency of the bond of carbon and the O—H radical or in the range of the elongation frequency of the bond between "O—H" and the water molecule. FIG. 9 illustrates the transmittance of distilled water and of newsprint for infrared radiation. It is essential when drying paper to a moisture content of the $u_\gamma=0.1$ that at least a portion of the water molecules which are bound to the cellulose OH groups be removed. This is evident from FIG. *7b* which, although concerning beech wood, indicates that the Helmholtz energy of the surface has a value greater than zero. The same conclusion can of course be reached utilizing molecular considerations.

Figure 8:
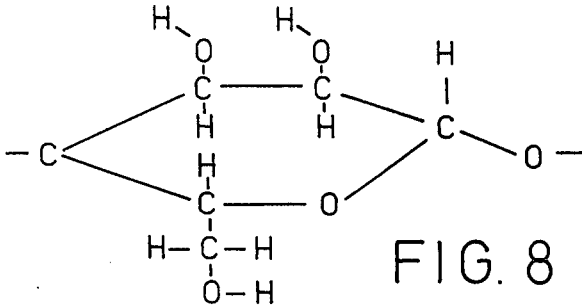
FIG. 8 is a schematic illustration of a cellulose molecule.

Referring now to FIG. 8, a cellulose molecule has the chemical formula $(C_6H_{10}O_5)_n$ with $n=2.5\text{–}10\times 10^5$. If it is assumed that in the cellulose molecule, each OH group forms a bond with one water molecule, then for one cellulose molecule, three water molecules will be bound. If it be further assumed that the number of cellulose molecules is the equivalent of one glucose unit, this quantity will have a weight of 162 g and, therefore, will be bound to a quantity of water having a weight of $3\times18$ g or 54 g. The moisture content is, therefore, $u_v=54/162=0.33$. Thus, molecular considerations clearly show that paper already contains a significant amount of completely dry cellulose surface at a moisture content $u_v=0.1$.

Figure 7A:
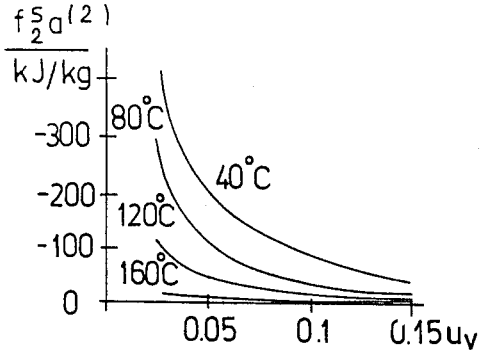
FIG. 7*a* is a graphical illustration showing the variation of the Helmholtz energizes of water bound in beech wood and free water.
Figure 7B:
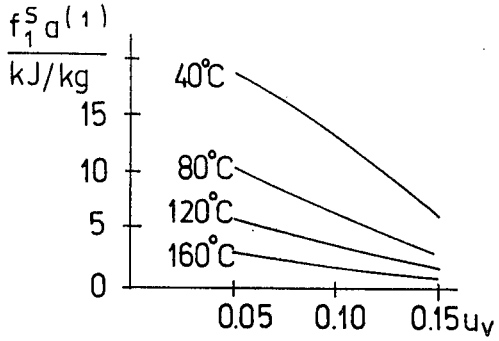
FIG. 7*b* is a graphical illustration showing the difference of the Helmholtz energies between a dry beech wood surface and wood material situated behind the surface.

The use of high frequency oscillators to facilitate drying is already known. The essential difference between the conventional application of an electrical field for drying and the application thereof according to the present invention is that in the latter case, the electrical field so applied has an energy which is only sufficient to weaken the bonds between the cellulose and water to an extent such that the water can be removed mechanically, i.e., by the technique according to the present invention. As noted above, such energy is only a fraction of the energy required for evaporation of the water and, therefore, both the size and power requirements of the apparatus will be significantly smaller than the size and power requirements of apparatus by which electrical fields are applied to effect evaporation of the water. Another significant difference is in the selection of the particular frequency. Thus, in connection with high frequency dryers of the prior art, the object is to set the water molecules in rotation. In direct contradistinction, according to the present invention, the electrical field has as its aim only to affect the bond between cellulose and water. As seen in FIG. 7*a*, when the temperature of a solid increases, the bonding force between water and cellulose correspondingly decreases. Experiments have been conducted which clearly demonstrate that infrared radiation is suitable for use in connection with the present invention. In such experiments, a wet paper specimen was placed upon a ceramic sinter plate against which the paper to be dried was pressed with the aid of a glass plate. When the pressure of the water was adjusted to 0.08 bar, the paper could be dried to a moisture content $u_v=0.16$. Due to the water-saturated ceramic plate below the paper to be dried and the glass plate situated above the same, no water could escape from the paper by evaporation.

Laboratory tests have also shown that the water suction drying according to the present invention need not necessarily be performed in a single step. In other words, even where the paper to be dried is removed from the water suction surface prior to the completion of the drying operation, the suction drying can be subsequently continued without detrimentally affecting the efficiency of the drying operation. As a result of these tests, a multiple cylinder dryer, illustrated in FIG. 10, has been designed, which dryer contains three separate types of water suction cylinders.

Figure 10:
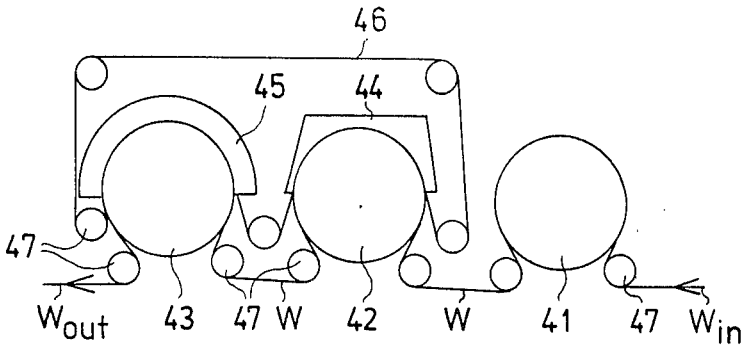
FIG. 10 is a schematic illustration showing a three-stage drying section of a paper machine or the like according to the present invention.

Thus, referring to FIG. 10, a wet paper web W is guided over three cylinders 41, 42 and 43, by guide rolls 47. The first cylinder 41 removes a large quantity of water from the web, e.g., to a moisture content $u_v=0.8-1.0$. Cylinder 41 is relatively simple in construction and comprises a cylinder of the type illustrated in FIG. 4*a* without any ancillary equipment being associated therewith. The second cylinder 42 is similar to cylinder 41 and, additionally, is fitted with a compressed air booster 44 whereby compressed air is applied over the surface of the paper web which does not contact the water suction of the cylinder. In this manner, the moisture content is reduced from $u_v=1.0-0.8$ to 0.3–0.5. In experiments which have been conducted, a moisture content $u_v=0.30$ has been achieved with the aid of compressed air having a pressure $p_u=21$ bar and wherein the pressure of water under the water suction surface is adjusted to be 0.34 bar. The third cylinder 43 is again similar to cylinder 41 and, additionally, has associated therewith an apparatus 45 for directing a high frequency field onto the paper to be dried as the same laps the third cylinder 43 so as to weaken the bonds between the cellulose and water. In this manner, a moisture content $u_v=0.1$ can be obtained.

Figure 12:
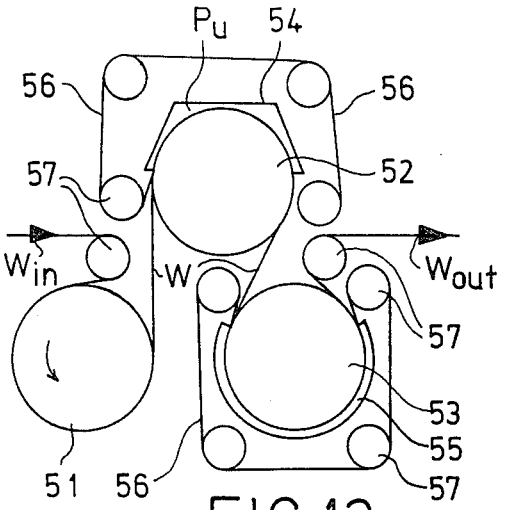
FIG. 12 is a schematic illustration showing another embodiment of a three-stage drying section according to the present invention.

Turning now to FIG. 12, a modification of the apparatus illustrated in FIG. 10 is shown. The web W enters the apparatus of FIG. 12 at $W_{in}$ and laps a water suction cylinder 51 of the type illustrated in FIG. 4*a* and which is not provided with any ancillary boosting equipment. The web W then passes over an air-boosted water suction cylinder 52. Thus, cylinder 52 is provided with an overpressure chamber 54 with the overpressure $P_u$ prevailing therein being used to boost the watering action in the manner described above. Further, the web W is pressed by means of a fabric 56 which is permeable to compressed air and which may comprise, for example, a porous rubber or the like, tightly against the water suction surface of cylinder 52 which comprises, for example, a fine porous nylon film such as that described above.

The web W travels from cylinder 52 over a third water suction cylinder 53 where dewatering is boosted by means of infrared radiation directed onto the outside of the web W by apparatus 55. A belt 56 is employed to apply pressure to the paper web as the same travels over cylinder 53, the belt 56 being transparent to infrared radiation. The web W departs at $W_{out}$ conducted by guide roll 57.

Figure 13:
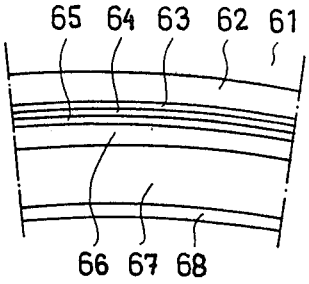
FIG. 13 is a schematic illustration showing the principles of the present invention when used in conjunction with the application of an overpressure to the object being dried.

Referring now to FIG. 13, the principles of the compressed air-boosted water suction drying method of the present invention are schematically illustrated. A volume of compressed air 61 is bounded by a porous rubber band 62 which bears against the paper to be dried 63 so that in this manner, the compressed air volume 61 will act on the paper 63. The rubber band 62 serves as a pressing member whereby the paper web 63 is urged tightly against the water suction surface 64 which can comprise, for example, a nylon film of the type described above. The pore size of the film 64 is preferably less than 0.2 μm. A base surface 65 having a high porosity, such as a felt or sinter metal, is provided beneath the water suction surface 64 and is relatively hard so that the pores will not be occluded under pressure. A foraminous steel sheet 66 situated under the support 65 and a water volume 67 and steel plate 68 complete the assembly.

Figure 14:
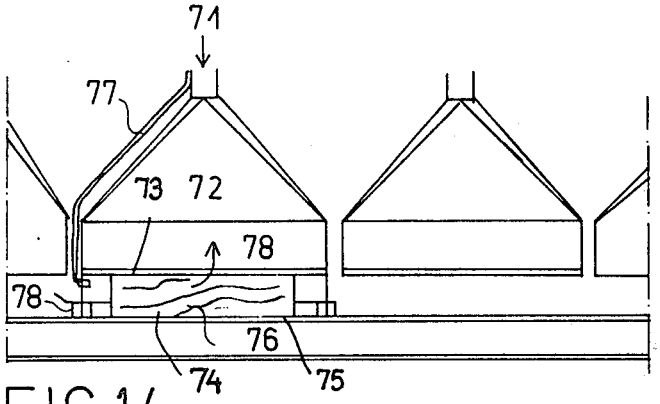
FIG. 14 is a schematic illustration of apparatus according to the present invention for drying timber pieces.

The manner in which the present invention may be applied to the drying of timber is illustrated in FIG. 14. In this apparatus, the object to be dried, i.e., timber, is pressed on opposed sides by respective water suction surfaces so that the drying is accomplished through two separate surfaces of the timber. Apparaus 71 is employed to press an upper water suction surface against the top surface of the timber piece 74 with substantial pressure. An upper water volume 72 is in liquid communication with the upper water suction surface 73. The timber piece 74 is situated with its lower surface contacting a lower water suction surface 75 which is in liquid communication with a volume of water 76. A labyrinth seal 78 encircles the outer periphery of the timber piece 74 so as to define a sealed space extending around the periphery of the timber piece 74 which is not covered by any water suction surface. A compressed air tube 77 has one end communicating with the sealed space and its other end with a source of compressed air. In this manner a pressurized volume is maintained in the space which encircles the periphery of the timber piece 74.

In operation, a plurality of timber pieces 74 are placed upon a continuous water suction surface 75, preferably at equal spacing. Thereafter, the upper water suction surfaces 73 are pressed against respective timber pieces 74 through hydraulic manipulation. When the movable upper water suction surfaces reach their lower position, the enclosed volumes around the timber pieces are sealed whereupon compressed air is directed through tube 77. In this manner, water suction continuously operates both through the upper and lower water suction surfaces 73 and 75, with the water flowing through the lower water suction surface 75 constituting only a minor drying. A final drying occurs after the compressed air is directed through tube 77 into the spaced defined by seal 78. The duration of the drying operation is determined by the thickness and quality of the timber pieces 74. It should also be noted that the drying can be boosted by means of an infrared radiator suitably accommodated in the pressurized volume in the manner described above.

Figure 15:
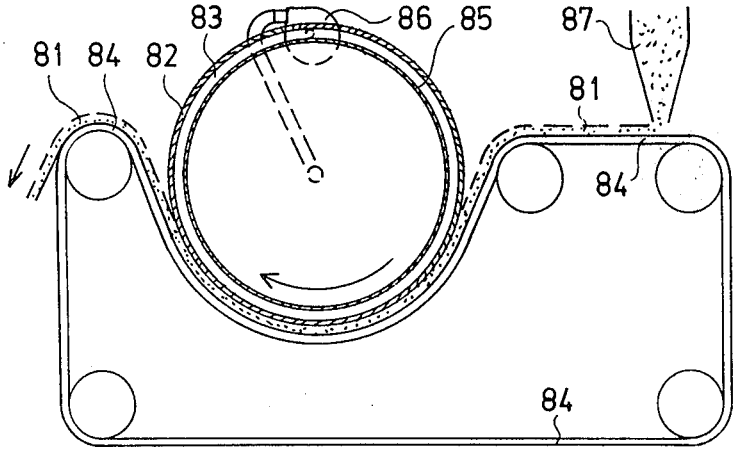
FIG. 15 is a schematic illustration showing apparatus according to the present invention for drying peat material.

Finally, referring to FIG. 15, apparatus according to the present invention for drying peat are illustrated. A continuous press felt loop 84 cooperates with a cylinder assembly comprising a water suction surface 82, an inner steel jacket 85 which together with the water suction surface 82 defines a water volume 83 and a water pump 86. The felt 84 laps a lower sector of the water suction roll 82, 83, 85. A layer of peat 81 is dispensed from a container 87 onto the press felt 84 whereupon the peat 81 enters a space between the roll and the felt 84. The felt 84 thus presses a thin course of peat, preferably of a few millimeters in thickness, against the fine porous water-suction surface 82. The water volume 83 is maintained at a subatmospheric pressure so that according to the present invention, water flows from the peat into the water suction surface 82 and into the water volume 83. From the water volume 83, the water is drawn off with the aid of the water pump 86 which is mounted on the periphery of the cylinder for rotation therewith. The output side of the water pump 86 is connected with a movable joint to the center of the cylinder whereby water extracted from the peat can be conducted by a stationary pipeline to a desired location. If it is desired to use higher contact pressures between the felt 84 or equivalent belt and the water suction surface, it is only necessary to add additional pressing rollers or, alternatively, a pressurized volume.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A method for drying an object constituted by a porous web-like material, such as a paper web, a granular material, such as peat, or a solid material, such as wood, comprising the steps of:

adapting the object to be dried so that the same has a liquid-saturated fine porous suction surface in contiguity therewith;

placing the suction surface in liquid communication with a liquid volume; and maintaining the liquid volume at an underpressure relative to the pressure of the liquid in the object to be dried;

whereupon liquid flows from the object to be dried into the suction surface.

2. The method of claim 1 wherein said step of adapting includes situating the object to be dried in contiguity with a liquid-saturated surface of a fine porous suction member.

3. The method of claim 1 wherein the object to be dried is situated in pressure contact with the suction member surface.

4. The method of claim 1 wherein the suction member is constituted by the object to be dried.

5. The method of claim 1 including the further step of applying an overpressure to the object to be dried to facilitate the flow of liquid from the object into the suction surface.

6. The method of claim 1 including the further step of directing onto the object to be dried radiation of a type which is absorbed by the object to facilitate the flow of liquid from the object into the suction surface.

7. Apparatus for drying an object constituted by a porous web-like material, such as a paper web, a granular material, such as peat, or a solid material such as wood, comprising:

a fine porous liquid suction surface adapted to be in contiguity with the object to be dried, the fine pores of said liquid suction surface having a radii within the range of from 0.05 to 2.0 $\mu$m;

means for defining a liquid volume in liquid communication with said fine porous liquid suction surface; and means in communication with said liquid volume defining means for maintaining the liquid therein at an underpressure relative to the pressure of the liquid in the object to be dried.

8. The combination of claim 7 further including means for applying an overpressure to a side of the object to be dried which is separated from said fine porous liquid suction surface by the object to be dried.

9. The combination of claim 7 further including means for directing radiation onto the object to be dried of the type which is absorbed by the object to be dried.

10. The combination of claim 7 further including means for tightly pressing the object to be dried against the fine porous liquid suction surface.

11. The combination of claim 10 wherein said pressing means includes a band member formed of resilient material, such as rubber or the like.

12. The combination of claim 7 wherein said fine porous liquid suction surface comprises a film of material having a thickness of less than about 1 mm.

13. The combination of claim 12 wherein said material is a sintered material.

14. The combination of claim 12 wherein said material is a microporous nylon.

15. The combination of claim 7 further including means for moving the object to be dried over a drying path.

16. The combination of claim 15 wherein said moving means comprises at least one cylinder rotatably mounted about an axis of rotation, the object to be dried lapping said cylinder over a sector thereof, and said cylinder having an outer surface constituted by said fine porous liquid suction surface and wherein the interior of said cylinder comprises said liquid volume defining means, and a liquid draining passage in communication with said liquid volume defining means.

17. The combination of claim 16 further including pump means in communication with said liquid volume defining means and drain passage.

18. The combination of claim 16 further including band means formed of a permeable material in overlying relationship with at least a sector of at least one cylinder for urging the object to be dried against the fine porous water suction surface.

19. The combination of claim 18 wherein said band means comprises an endless loop of fabric material.

20. The combination of claim 16 further including means for applying an overpressure to the side of the object opposite to the side thereof which contacts the liquid suction surface to facilitate liquid flow from the object to be dried to the liquid suction surface.

21. The combination of claim 20 wherein said overpressure applying means comprises a chamber located over the sector of the cylinder which is lapped by the object to be dried and pressure means communicating with said chamber.

22. The combination of claim 16 further including a means for cleaning the liquid suction surface of the cylinder.

23. The combination of claim 22 wherein said cleaning means comprise water jet means adapted to direct jets of water on a sector of the cylinder which is not lapped by the web-like object.

24. The combination of claim 16 wherein the apparatus comprises at least three cylinders located such that the object consecutively laps respective sectors thereof, and further including means for applying an overpressure on the object as it laps the respective sector of the second cylinder in the direction of movement thereof and means for applying radiation to the object as it laps the respective sector of the third cylinder in the direction of movement thereof.

25. The combination of claim 24 further including band means formed of a permeable material in overlying relationship with at least one of said second and third cylinders for urging the object against the fine porous water suction surface.

26. The combination of claim 7 including a pair of mutually opposed fine porous liquid suction surfaces between which the object to be dried is pressed and means for applying an overpressure on the object to be dried on sides thereof which are not covered by said pair of liquid suction surfaces.

27. A method for drying granular peat material comprising the steps of:

situating the peat material in contiguity with a liquid-saturated fine porous suction surface;

placing the suction surface in liquid communication with a liquid volume; and maintaining the liquid volume at an under pressure relative to the pressure of the liquid in the peat material.

28. The method of claim 27 wherein the fine porous suction surface constitutes parchment paper.

29. The method of claim 27 further including the steps of urging the peat material against the suction surface with a pressure of about 10 bars and the liquid volume is maintained at an under pressure of about 0.21 bar whereby a moisture content of the peat material is obtained which is about 45% of the wet weight of the peat material.

* * * * *